US005632665A

United States Patent [19]

Yanai

[11] Patent Number: 5,632,665

[45] Date of Patent: May 27, 1997

[54] DEVICE FOR PRESSING FRAME FOR APERTURED GRILLS

[75] Inventor: Kunihiko Yanai, Aichi, Japan

[73] Assignee: Sony Corporation, Tokyo, Japan

[21] Appl. No.: 506,873

[22] Filed: Jul. 25, 1995

[30] Foreign Application Priority Data

Jul. 26, 1994 [JP] Japan ..... 6-194888

[51] Int. Cl.[6] ..... H01J 9/02

[52] U.S. Cl. ..... 445/68; 269/266

[58] Field of Search ..... 445/37, 67, 68; 269/34, 266, 265

[56] References Cited

U.S. PATENT DOCUMENTS 626,427 6/1899 Jones ..... 269/266 X
4,572,564 2/1986 Cipolla ..... 269/266 X
4,746,315 5/1988 Sumiyoshi ..... 445/37
5,119,658 6/1992 de Smet ..... 72/57
5,183,426 2/1993 Ho-jin et al. ..... 445/68

*Primary Examiner*—Kenneth J. Ramsey
*Attorney, Agent, or Firm*—Hill, Steadman & Simpson

[57] ABSTRACT

The present invention provides a pressure device to press a pair of members facing each other of a frame under the same pressure condition. A pressure device 5 for pressing top and bottom members 103 of a frame 101 for apertured grills, provided with a pair of pressure blocks 31 provided movably in the direction to bring the pressure blocks closer to and farther from each horizontal member 103 at the position facing to the top and bottom horizontal members respectively outside the frame 101, driving means 15 for moving synchronously each pressure block 31 in the direction to bring each pressure block 31 closer to and farther from each horizontal member 103, and pressure rolls 33 for contacting with each horizontal member 103 and supported on each pressure block 31, respectively.

12 Claims, 9 Drawing Sheets

DEVICE FOR PRESSING FRAME FOR APERTURED GRILLS

BACKGROUND OF THE INVENTION

1. Field of the Invention

The present invention relates to a device to press a frame for a apertured grill which constitutes a color selector of a color cathode ray tube (abbreviated as CRT hereinafter).

2. Description of Related Art

An apertured grill is provided as a color selector in a trinitron type CRT which is used for television receivers and television monitors of computers.

As shown in FIG. 7, an apertured grill 1 is provided with a frame 101 formed in a shape nearly rectangular and a grill 107 spread tightly inside the frame 101.

The frame 101 comprises top and bottom horizontal members 103 and right and left vertical members 105 connecting to right and left ends of the horizontal members, and the horizontal members 103 are curved so that the distance between the top and bottom horizontal members is wider at the middle of the horizontal members between right and left ends thereof than that at the right and left ends of the horizontal members, and curved so that the right and left ends of the horizontal members are in the front and the middle between right and left ends in the rear.

On the grill 107 many vertically long slits 109 are provided side-by-side in the horizontal direction with a certain interval, and the grill 107 is tensioned tightly inside the frame 101 by welding a sheet flat apertured grill 3, on which the slits 109 are formed, on the front sides of the vertical members 105 as shown in FIG. 8 and then by removing the outside portion of the flat apertured grill 3 wherein the outside portion means the portion extending outside beyond the frame 101.

The flat apertured grill 3 is welded on the horizontal members 103 as described herein under. The top and bottom horizontal members 103 are forced to deform so as to get near each other, and a flat apertured grill 3 which is being extended vertically is placed on the front side of the frame 101, and the apertured grill 3 is welded so that the grill 107 does not slack between the slits 109 after completion of the apertured grill 1.

FIG. 9 shows schematic structure of a conventional pressure device for pressing and deforming the top and bottom horizontal members 103.

The pressure device 41 is provided with upper and lower pressure mechanisms 43 and 45 for pressing the top and bottom horizontal members 103 from the outside of the frame 101 respectively.

The upper pressure mechanism 43 has a fixed pressure lever 4301 provided above the top horizontal member 103, and the lower pressure mechanism has a slide shaft 4501 movable in the direction to get near to and get far from the bottom horizontal member 103 and a movable pressure lever 4503 supported rotatably at the top end of the slide shaft 4501 and provided under the bottom horizontal member 103.

At both the right and left ends of the pressure levers 4301 and 4503 of the upper and lower pressure mechanisms 43 and 45, pressure blocks 4303 and 4505 are respectively supported rotatably, and on both the right and left ends of the pressure blocks 4303 and 4505, pressure tips 4305 and 4507 which are engageable with the top and bottom horizontal members 103 are provided upward.

When the top and bottom horizontal members 103 are pressed using the pressure device 41, the pressure lever 4503 of the lower pressure mechanism 45 is moved toward the upper pressure mechanism 43 through the movement of the slide shaft 4501, and during the movement, the pressure tips 4507 of the pressure lever 4503 are brought into contact with the bottom horizontal member at four positions of two places on the right and two places on the left with a certain distance between the twos, and the pressure tips 4305 of the upper pressure mechanism 43 are brought into contact with the top horizontal member 103 at four positions of two places on the right and two places on the left with a certain distance between the twos, and the pressure lever 4503 of the lower pressure mechanism is moved further toward the upper pressure mechanism 43, thus the further movement causes the pressure to press the horizontal members 103.

Then, the rigidity of the bottom horizontal member 103 is higher at the right and left end portions of the bottom horizontal member 103 than at the middle portion between right and left ends of the bottom horizontal member 103 because at the right and left ends of the bottom horizontal member 103, the bottom horizontal member 103 is connected with the vertical members 105, consequently after the contact of the pressure tips 4305 and 4507 with the bottom horizontal member 103, the pressure tips slide from the middle portion between right and left ends, where the rigidity is low, to both the end directions of the horizontal members 103.

However, because the conventional pressure device described herein above is so constituted that only the pressure lever 4503 of the lower pressure mechanism 45 is supported rotatably out of upper and lower pressure levers 4301 and 4503 and only the pressure lever 4503 is made to move toward the upper pressure mechanism 43, when the top and bottom horizontal members 103 are pressed, the mechanism of the lower pressure mechanism 45 in which the pressure tips 4507 contact with the bottom horizontal member 103 while the pressure lever 4503 is rotating and moving is different from the mechanism of the upper pressure mechanism 43 in which the pressure tips contact with the top horizontal member 103 while the pressure lever 4301 is fixed, that is, the position of contact point between the pressure tips 4305 of the upper pressure mechanism 43 and the upper horizontal member 103 is different from the position of contact point between the pressure tips 4507 of the lower pressure mechanism 45 and the lower horizontal member 103.

Since the pressure tips 4305 and 4507 are, conventionally, so structured as to slide on the horizontal members 103 when pressuring the horizontal members 103, the difference in rigidity depending on the position of contact point between the pressure tips 4305 and 4507 and the horizontal members 103 causes the difference in frictional force between the friction of the top horizontal member 103 with the pressure tips 4305 and the friction of the bottom horizontal member 103 with the pressure tips 4507, and the difference in frictional force makes a difference in sliding of the pressure tips 4305 and 4507 on the horizontal members 103, and thus the position of contact point of the pressure tips 4305 with the upper horizontal member 103 is different from the position of contact point of the pressure tips 4507 with the bottom horizontal member 103.

The difference in position causes the difference in pressing condition between the top horizontal member 103 and the bottom horizontal member 103, and the difference in pressing condition causes the twisting of the frame 101 and the grill 107 welded on the top and bottom horizontal members 103, and the twisting causes the slacking of the grill 107 between the slits 109, the slacking is significantly disadvantageous.

In addition, since the conventional mechanism is so structured that the pressure tips 4305 and 4507 contact with the horizontal members 103 at positions separated toward both ends of the horizontal members with a certain wide space, the positioning of contact points near the ends causes the stress concentration at the contact points of the horizontal members 103 with the pressure tips 4305 and 4507, which causes the unbalanced stress on the horizontal members between contacting portion with the pressure tips 4305 and 4507 and non-contacting portion with the pressure tips 4305 and 4507. Thus, the horizontal members 103 are pressed unbalancedly, and the unbalanced stress causes the slacking of the welded grill 107 between the slits 109. Then, the slacking is significantly disadvantageous.

SUMMARY OF THE INVENTION

This invention is accomplished to solve the above mentioned problems of the conventional pressure device. The object of the present invention is to provide a pressure device for pressing a pair of members facing each other used for apertured grills under a balanced condition. Another object of the present invention is to provide a pressure device for pressuring all members with the same pressure.

To attain the object described herein above, the pressure device of the present invention is so structured as to press a pair of members, facing each other, of the frame comprising four members of top, bottom, right, and left members, in the inside direction from the outside of each member, and provided with a pair of pressure blocks installed movably in the direction of moving far from and near to each member at the places facing to the pair of members respectively outside the frame, a pair of driving means for moving synchronously the pressure blocks in the direction of moving far from and near to the pair of members, and pressure tips for contacting on the pair of members respectively supported with pressure blocks, respectively.

In the present invention, the pressure tips comprises a roller which is rotatable on the pair of members.

In the present invention, many pressure tips are provided, and each pressure tip is supported at the position of the pressure blocks with a certain space in the longitudinal direction of the pair of members.

In the present invention, many pressure tip moving mechanisms for moving the pressure tips in the direction of moving far from and near to the members are provided on the pressure block.

In the present invention, frame positioning means for positioning the frame at the position where the pressure tip is to be faced with the pair of members is provided additionally.

When the pair of members are pressed, the pressure blocks are moved synchronously in the direction of moving closer to the pair of members, and the pressure tips, supported on the pressure blocks, contact on the pair of members to press with the same movement, and thus the same pressure condition of the pressure tips is applied on all portion of the pair of members.

DETAILED DESCRIPTION OF THE PREFERRED EMBODIMENTS

Figure 1:
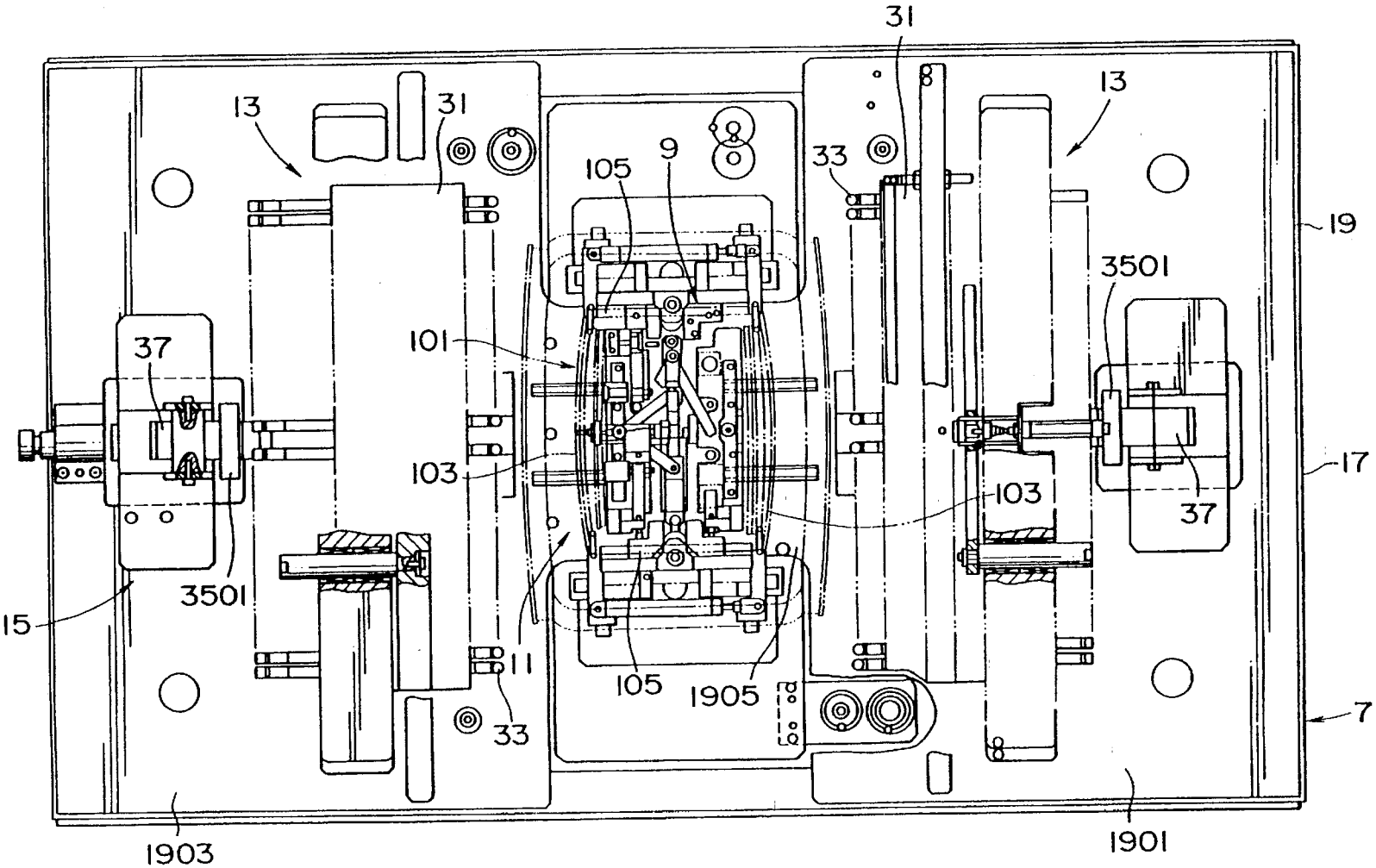
FIG. 1 is a plain view of a pressure device in accordance with the present invention.
Figure 2:
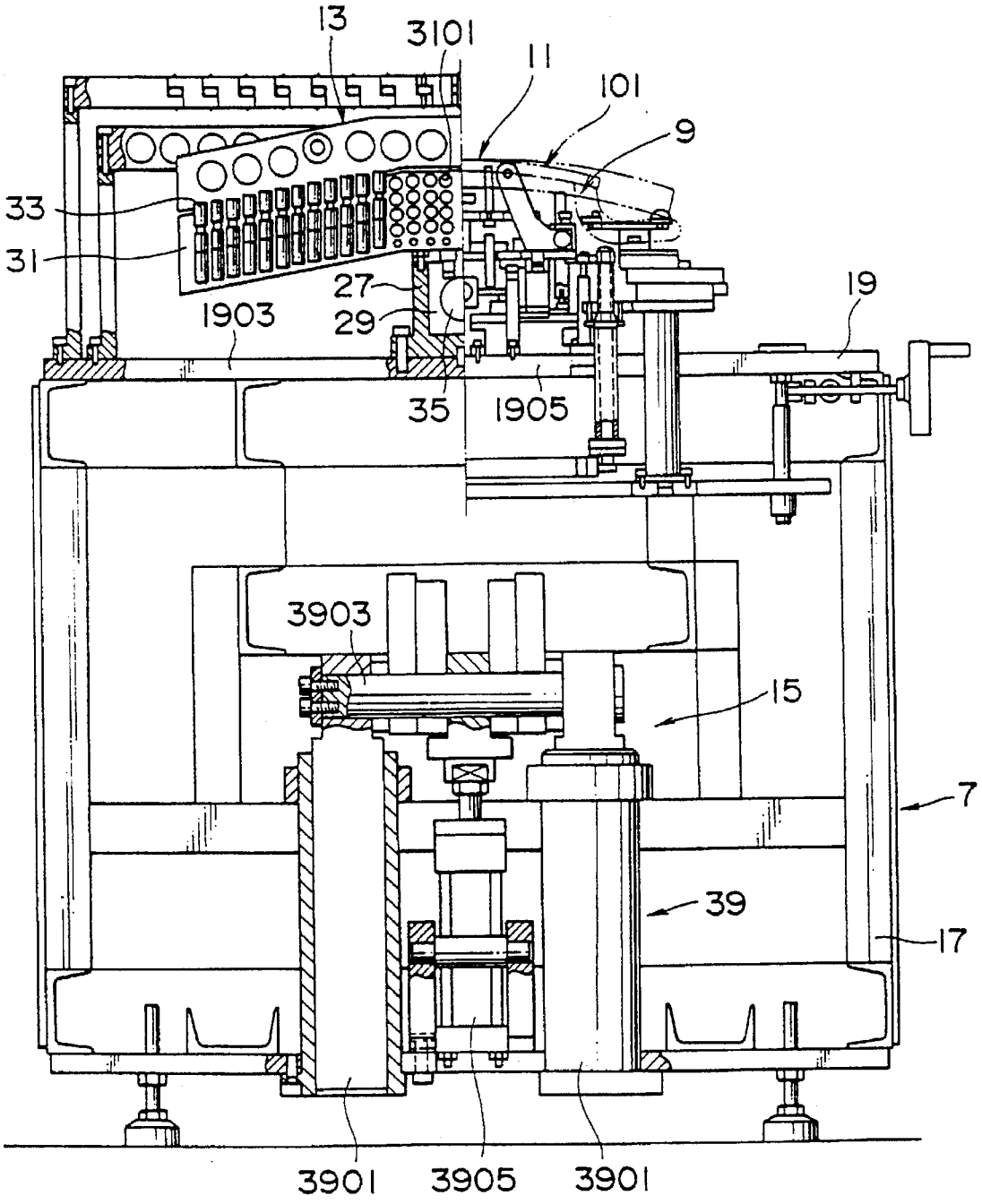
FIG. 2 is an elevational view of the pressure device shown in FIG. 1.
Figure 3:
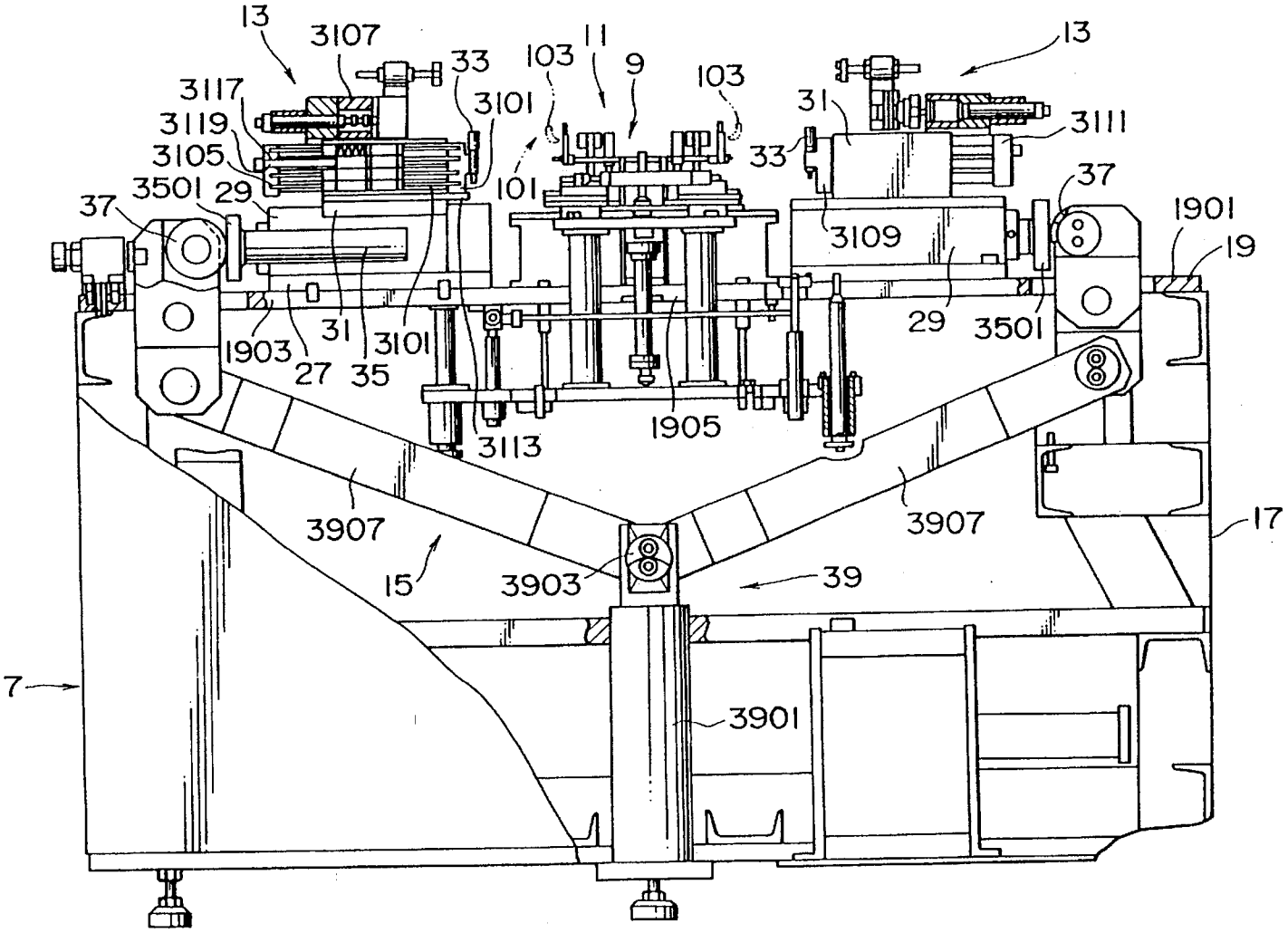
FIG. 3 is a side view of the pressure device shown in FIG. 1.

FIG. 1 is a plain view of a pressure device in accordance with the present invention, FIG. 2 is an elevational view of the same, and FIG. 3 is a side view of the same.

The pressure device 5 is provided with a base 7, frame supporting means 9 provided on the base 7, frame positioning means 11, two pressing means 13 for pressing the top and bottom horizontal members 103, and driving means for engaging with the top and bottom horizontal members 103 synchronously with the two pressing means 13 provided on the base 7.

The base 7 is rectangular shaped in the plain view with longer sides in the depth direction as shown in FIG. 1, and comprises a hollow frame 17 and a base plate 19 fixed on the hollow frame 17 as shown in FIGS. 2 and 3.

The base plate 19 comprises a front plate 1901, a rear plate 1903, and an intermediate plate 1905 connecting with the front plate 1901 and the rear plate 1903. The intermediate plate 1905 is formed so that the size of the intermediate plate in the width direction is smaller than those of the front plate 1901 and the rear plate 1903 as shown in FIG. 1.

Figure 4:
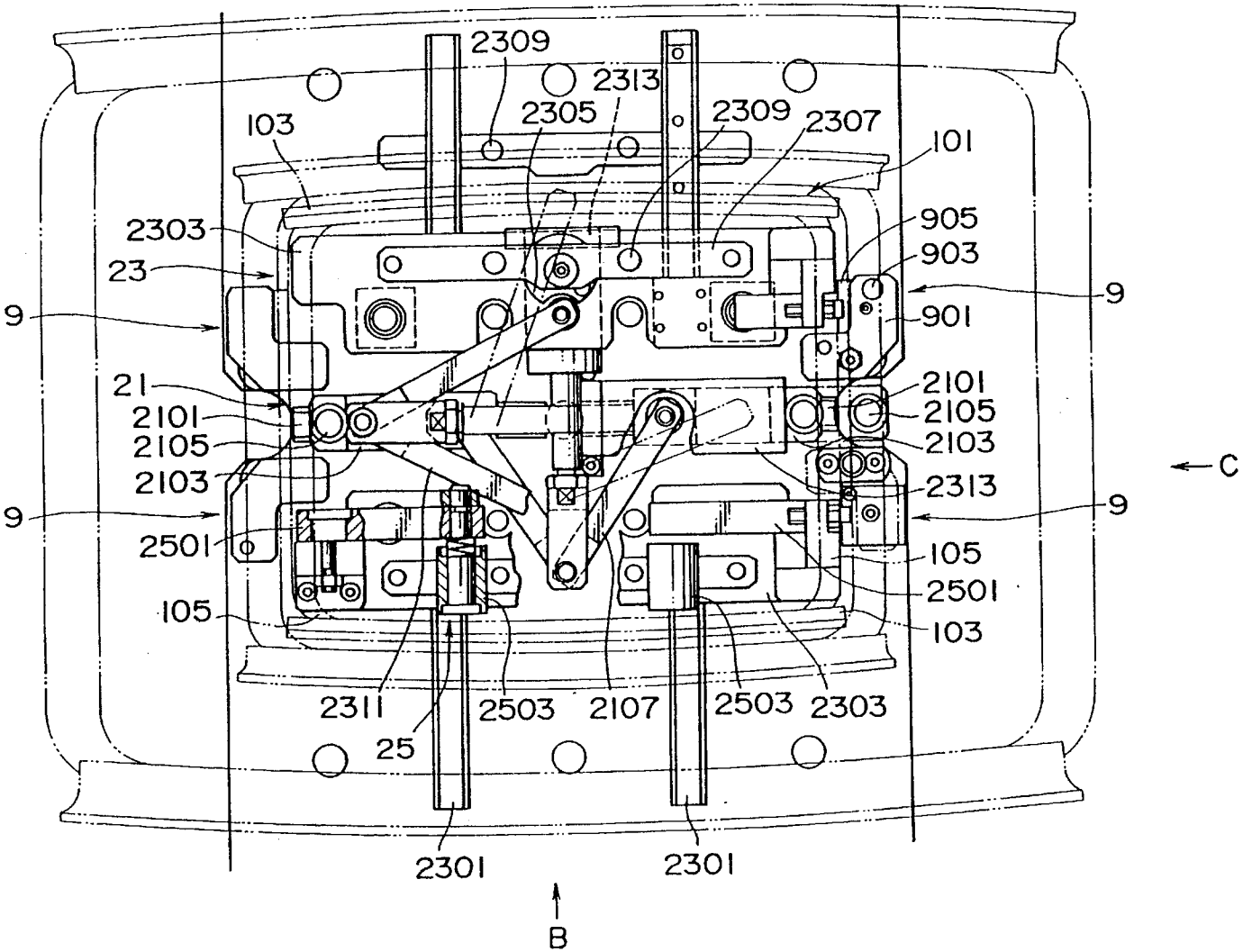
FIG. 4 is an enlarged plain view of the intermediate plate of the pressure device shown in FIG. 1.
Figure 5:
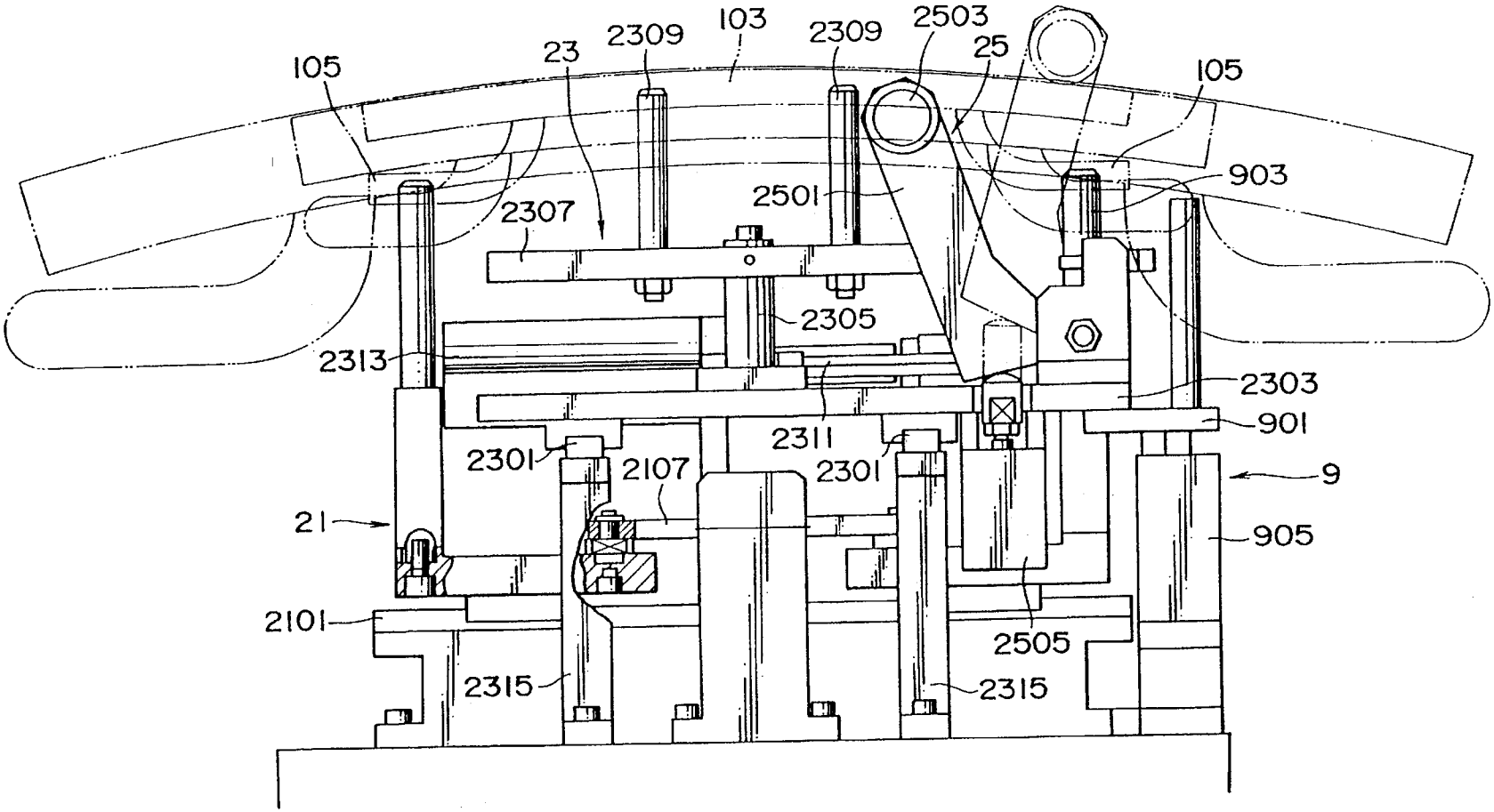
FIG. 5 is a side elevational view of FIG. 4 viewed from B.
Figure 6:
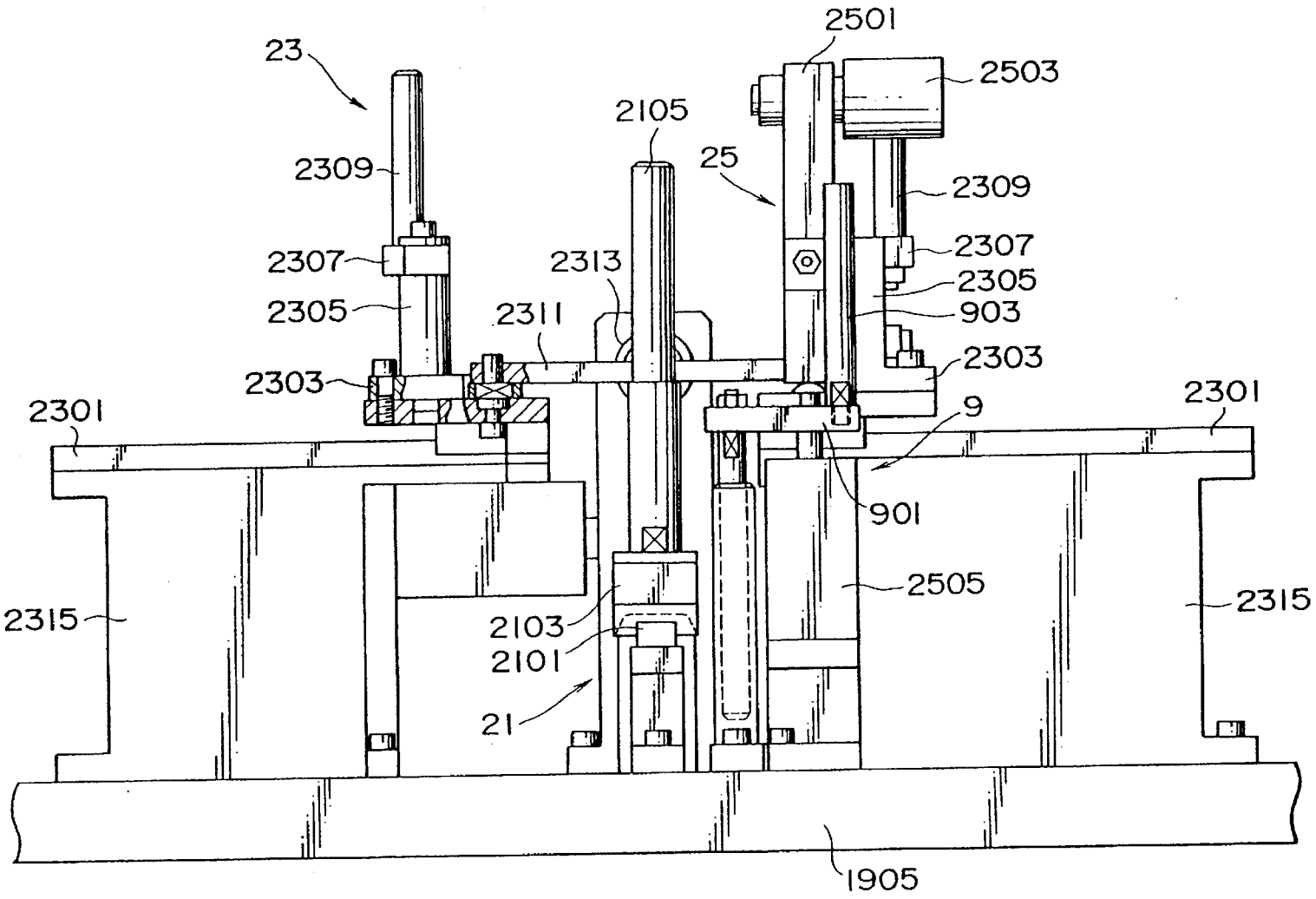
FIG. 6 is a side elevational view of FIG. 4 viewed from C.
Figure 7:
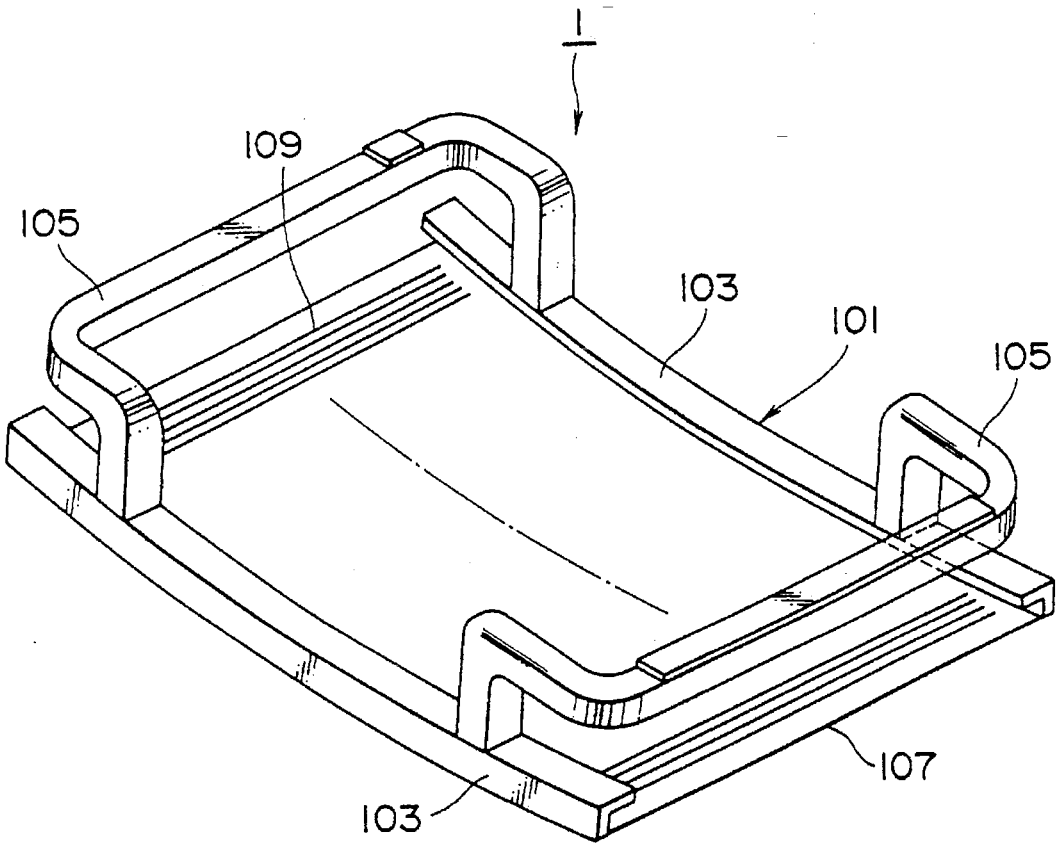
FIG. 7 is a perspective back side view of an apertured in accordance with the present invention.
Figure 8:
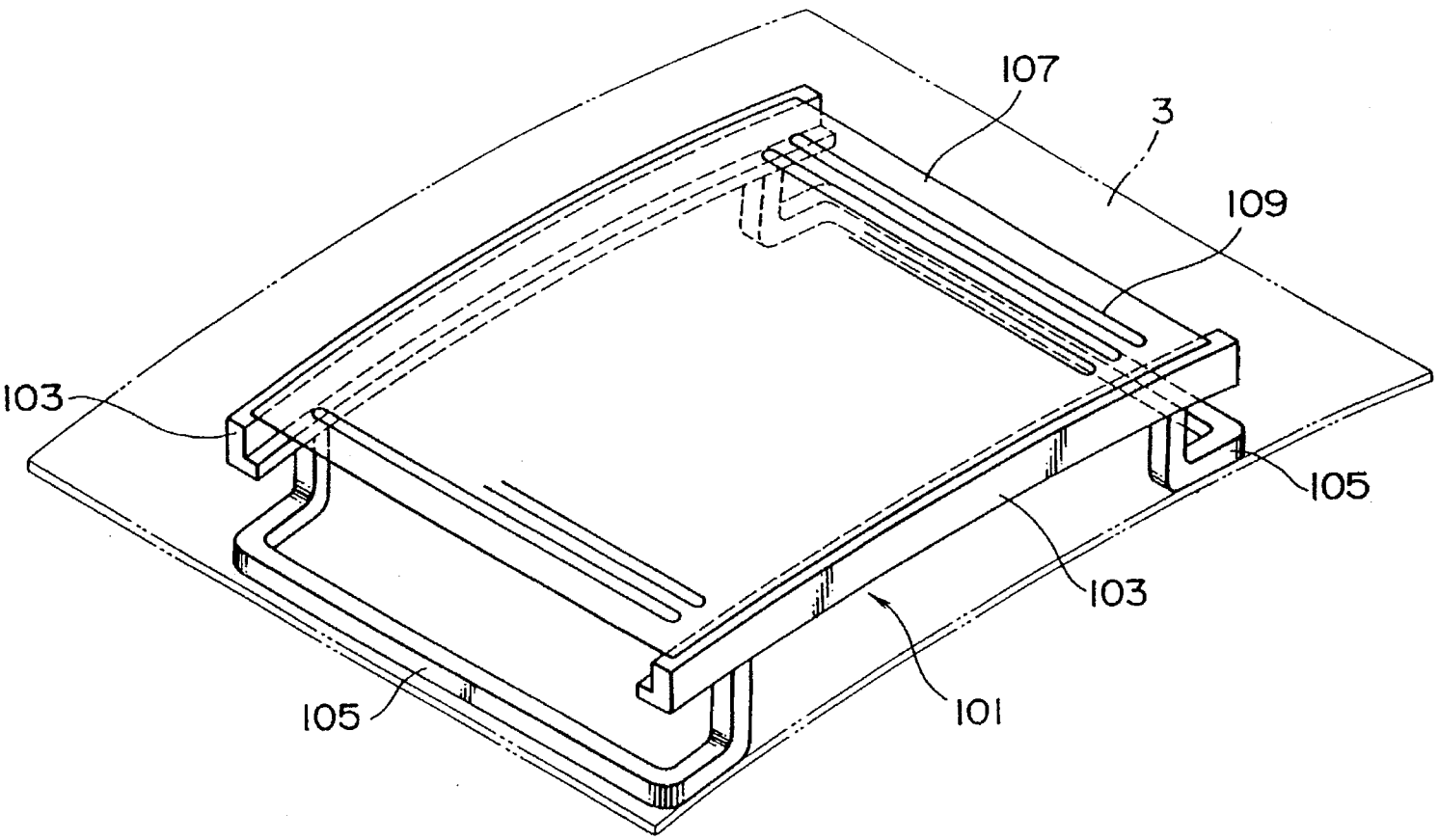
FIG. 8 is a perspective view illustrating the welding of a flat apertured grill on a frame.
Figure 9:
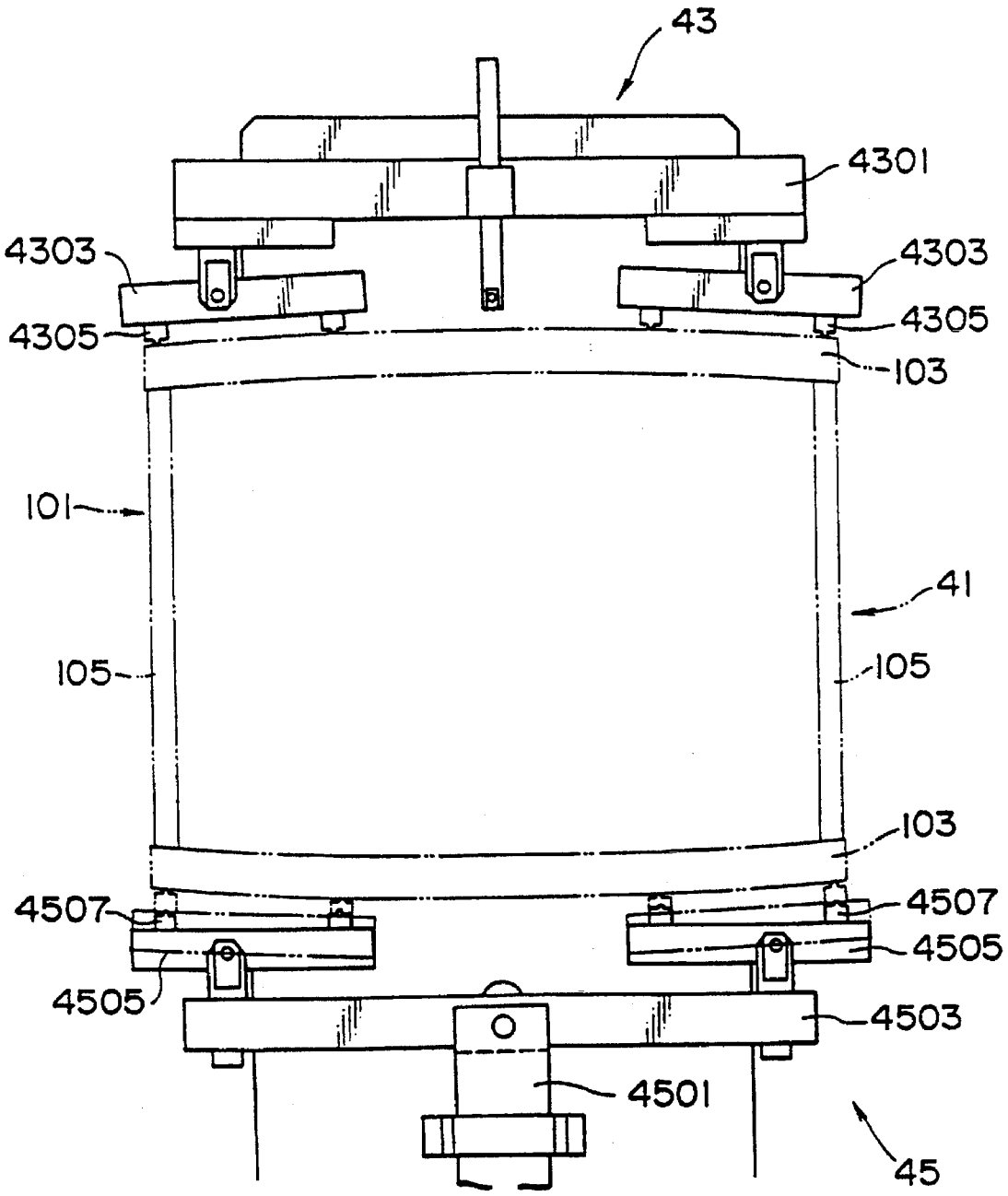
FIG. 9 (PRIOR ART)
FIG. 9 is a schematic structural view of the pressure device in accordance with the conventional design.

FIG. 4 is an enlarged plain view of the intermediate plate 1905. FIG. 5 is a side elevational view from B. FIG. 6 is a side elevational view from C. Two frame supporting means 9 are provided on both the right and left sides of the intermediate plate 1905 respectively with a certain space in the depth direction of the base 7 as shown in FIG. 4.

The frame supporting means 9 is provided with a receiving plate 901 provided above the intermediate plate 1905 as shown in FIG. 4, a supporting pin 903 standing from the receiving plate 901, and a cylinder 905 for moving vertically the receiving plate 901 provided vertically on the side of the intermediate plate 1905 as shown in FIGS. 5 and 6, and the middle portions of the vertical members 105 are supported on the supporting pins 903.

The frame supporting means 9 is so constructed as to move vertically the frame 101 through the supporting pin 903 by extending each cylinder synchronously. The supporting pin is replaceable with other pins with desired size and shape depending on the size of a frame 101 to be placed on (in the embodiment up to the size of 27 inches).

The frame positioning means 11 comprises X-positioning mechanism 21 for positioning the frame 101 in the width direction of the base 7, Y-positioning mechanism 23 for positioning the frame 101 in the depth direction of the base 7, and Z-positioning mechanism 25 for positioning the frame 101.in the vertical direction of the base 7. In the embodiment, the frame positioning means 11 is so structured as to position the frame 101 with the maximum size up to 27 inches in the directions of width, depth, and vertical directions of the base 7.

As shown in FIGS. 4 and 5, the X-positioning mechanism 21 provided with a guide rail 2101 extending in the width direction of the base 7 standing on the intermediate plate 1905, right and left movable blocks 2103 supported movably on the guide rail 2101, positioning pins 2105 standing on each movable block 2103, a splitting link 2107 provided between the right and left movable blocks, and a cylinder 2109 connected to the splitting link 2107.

The X-positioning mechanism 21 is so structured as to move the right and left movable blocks 2103 on the guide rail 2101 through the splitting link 2107 by extending and telescoping the cylinder 2109, to engage and disengage each positioning pin 2105 with the right and left vertical members 105 from the inside, and to position the frame 101 in the width direction of the base 7 while engaging each positioning pin 2105 with the vertical members 105.

As shown in FIGS. 4 and 5, the Y-positioning mechanism 23 is provided with right and left guide rails 2301 provided at the positions above the movable blocks 2103 with a certain space in the width direction of the base 7, front and rear movable plates 2303 supported movably on the guide rails 2301, supporting plates 2307 supported on the movable plates 2303 with the space of a support 2305, positioning pins 2309 standing on the supporting plate 2307 at the positions with a certain interval in the width direction, a splitting link 2311 provided between the front movable plate 2303 and the rear movable plate 2303, and a cylinder connected to the splitting link 2311.

In FIGS. 5 and 6, the numeral 2315 is supports standing on the intermediate plate 1905 under and along the front and rear guide rails, the guide rails 2301 are supported on the supports 2315.

The Y-positioning mechanism 23 is so structured as to move the front and rear movable plates 2303 with the space of the splitting link 2311 on the guide rails 2301 by extending and telescoping motion of the cylinder 2313, to engage and disengage each positioning pin 2309 with the top and bottom horizontal member 103 from the inside, and to position the frame 101 in the depth direction of the base 7 while engaging each positioning pin 2309 with the horizontal members 103.

As shown in FIGS. 4 and 5, the Z-positioning mechanism 25 is provided with swing levers 2501 supported swingably in the vertical direction at the right and left ends of the front and rear movable plates 2303, press rollers 2503 fixed on the top of each swing lever 2501, and a cylinder 2505 supported by the front and rear movable plates 2303 and provided under the swing levers 2501.

The Z-positioning mechanism 25 is so constituted that the bottom end of the swing lever 2501 contacts constantly with the cylinder 2505 under gravitation, and the swing lever 2501 swings up and down corresponding to extension and telescoping motion of the cylinder 2505, and when the swing lever 2501 moves up the press roller 2503 is positioned above the supporting pin 903, in this condition, the frame 101 is lifted by the frame supporting means 9 to bring the vertical members 105 into contact with the press roller 2503, thereby the frame 101 is positioned in the vertical direction of the base 7.

The pressure means 13 are provided on the front plate 1901 and rear plate 1903 of the base plate 19.

As shown in FIGS. 2 and 3, the pressure means 13 is provided with a guide member 27 standing on the middle position in the width direction of the base 7, a slider 29 supported on the guide member 27 and movable in the depth direction of the base, a pressure block 31 fixed on the top of the slider 29, and many pressure rollers 33 supported on the pressure block 31.

As shown in FIG. 3, the slider 29 is screwed with a bolt 35, the head thereof 3501 is projected from the pressure block 31 and provided in the opposite side of the intermediate plate 1905.

As shown in FIG. 2, the pressure block 31 is so formed that the bottom side of the pressure block 31 is distant from the base plate 19 at the middle of the pressure block 31 in the width direction of the base 7 and is closer to the base plate 19 at the position nearer to the ends of the pressure block 31 in the width direction of the base 7 corresponding to the curve of the horizontal members 103 in the depth direction of the frame 101, and as shown in FIGS. 2 and 3, at the positions on the pressure block 31 with a certain interval in the width direction of the base 7, four holes 3101 passing through in the depth direction of the pressure block 31 are provided with a certain interval in the vertical direction.

As shown in FIG. 3, guide shafts 3103 and 3105 are inserted into the four holes 3101 from the intermediate plate 1905 side and from the opposite side respectively, and in the holes 3101 springs 3107 are provided in spaces between both the guide shafts 3103 and 3105.

The ends of each guide shafts 3103 and 3105 project form the holes 3101 toward the intermediate plate 1905 and the opposite side respectively, the ends of the guide shafts 3103 projecting from the holes 3101 are fixed to a connecting member 3109, the ends of the guide shafts 3105 projecting from the holes 3101 are fixed to a connecting member 3111.

A screw member 3113 is provided through the bottom of the connecting member 3109 in the intermediate plate side, the end of the screw member 3113 is screwed on the bottom of pressure block 31, the connecting member 3109 is forced toward the pressure block 31 side by a spring 3115 wound on the screw member 3113, thereby the guide shafts 3103 in the intermediate plate 1905 side does not fall down from the holes 3101.

As shown in FIG. 3, a female screw 3117 is formed on the connecting member 3111 in the opposite side from the intermediate plate 1905, a male screw 3119 formed on one of the guide shafts 3115 is screwed on the female screw 3117, and the end of the guide shaft 3105 on which the male screw 3119 is formed projects into the outside of the connecting member 3111.

On the base end of the guide shaft 3105 on which the male screw 3119 is formed, a ring stopper (not shown in the figures) is formed, the stopper engages with a step (not shown in the figures) formed on the holes 3101, thereby the guide shafts 3105 does not fall down from the holes 3101.

The connecting member 3111 in the intermediate plate 1905 side is so constructed as to move in the direction closer to and farther from the pressure block 31 by screwing or unscrewing the guide shafts 3105 on which the male screw 3119 is formed, in the embodiment, a pressure tip moving mechanism comprises the guide shafts 3103 and 3105, the connecting members 3109 and 3111, and the screw member 3113.

As shown in FIGS. 1 and 3. The pressure rollers 33 are supported rotatably through vertical shafts on the top of the connecting member 3109 in the intermediate plate 1905 side, the press rollers 33 are provided side-by-side in the width direction of the base 7 with scarce spaces between rollers, in the embodiment, thirty-two press rollers are provided on each pressure means 13 corresponding to the length of the horizontal members 103 of a 27 inch type frame 101.

As shown in FIG. 3, the driving means 15 comprises rollers 37 engageable with the head 3501 of the bolt 35 of each pressure means 13 and an engaging mechanism 39 for engaging the rollers 37 with the head 3501 and provided on the hollow frame 17.

As shown in FIG. 2, the engaging mechanism 39 comprises two guide members 3901 supported movably in the vertical direction on the base 7 at the positions under the intermediate plate 1905 with a certain space in the width direction, a shaft member 3903 supported rotatably at the top end of these guide members 3901, a cylinder 3905 connected to the shaft member 3903 supported on the base 7 through a bearing, and front and rear links 3907 for connecting between the shaft member 3903 and each roller 37.

The engaging mechanism 39 is so structured that each roller 37 engages or disengages with the head 3501 through the link 3907 by extending and telescoping motion of the cylinder 3905, thereby the pressure block 31 are slid in the direction closer and farther.

The pressing mechanism on the top and bottom horizontal members by the pressure device 5 is described hereinafter.

The frame 101 is placed on the supporting pins 903 of the frame supporting means 9 with the grill 107 side up, the swing lever 2501 of the Z-positioning mechanism 25 is swung upward to provide the press rollers 2503 above the supporting pins 903, the frame 101 is lifted by the frame supporting means 9 to clamp the vertical members 105 between the press roller 2503 and the supporting pins 903, and thereby the frame 101 is positioned in the vertical direction of the base 7.

Then, the frame 101 is positioned in the width and depth directions by using the X-positioning mechanism 21 and Y-positioning mechanism 23, and thereby the frame 101 is fixed so that the top and bottom horizontal members 103 is faced to the press rollers 33.

Each press roller 33 facing to the horizontal members 103 is moved using the guide shaft 3105 on which the male screw 3119 is formed so that the horizontal members are positioned far at the middle of the pressure block 31 from the pressure rollers 33 in the width direction and positioned closer at the position nearer to the ends of the pressure block 31 to the pressure rollers 33 in the width direction, thereby the pressure of the pressure rollers 33 onto the horizontal members 103 are controlled.

Then, the distance between the press rollers 33 and the horizontal members 103 at any point distant from the symmetrical center in the width direction of the slider 29 is adjusted to be equal, and also the distance between both the press rollers 33 and the horizontal members 103 facing to the intermediate plate 1905 in the depth direction of the base 7 is adjusted to be equal.

After adjustment of each press roller 33, the front and rear pressure blocks 31 are moved closer each other with the driving means 15, the pressure rollers 33 are brought into contact with the horizontal members 103 successively in the order starting from rollers at the right and left ends of the pressure block 31, and each pressure block 31 is moved additionally to move each pressure roll 33 on the horizontal members 103 from the intermediate plate 1905 side in the width direction, where the rigidity is low, to both the end sides, thereby each pressure roll 33 presses the top and bottom horizontal members 103.

Accordingly in this embodiment, each pressure means 13 for the top horizontal member 103 and the bottom horizontal member 103 comprises the pressure block for moving in the direction closer to and farther from the top and bottom horizontal members 103 with the driving means 15, and pressing rolls 33 supported by the pressure block 31, thereby, when the top and bottom members 103 are pressed, the press roll 33 of each pressure means 13 is brought into contact with each horizontal member 103 in the same motion of the press roll 33 to get near to the top and bottom horizontal members 103, therefore the top and bottom horizontal members 103 are pressed under the same pressure.

In the embodiment, the press rolls 33 are structured so as to press the horizontal members 103 and to move rotationally on the horizontal members 103 by motion of each pressure block 31, thereby the difference in friction due to the difference in rigidity depending on the contact position of each pressure roll 33 with the horizontal members 103 is eliminated, and the contact positions of the press rolls 33 with the top horizontal member 103 is the same as the contact positions of the press rolls 33 with the bottom horizontal member 103, thus the top and bottom horizontal members are pressed under the same pressure condition.

Accordingly, the twisting of the frame 101 and flat apertured grill 3, and the slacking of the grill between slits 109 after welding can be prevented.

In the embodiment, many pressure rolls 33 of each pressure means 13 are provided side-by-side with scarce spacing between rolls in the width direction of the base 7, and the horizontal members 103 are pressed by these press rolls 33, the horizontal members 103 are pressed at many positions with a small pitch, thus the horizontal members are pressed evenly through the length thereof.

In the embodiment, each press roll 33 is structured so as to move individually in the direction closer to and farther from the horizontal members 103 by the guide shaft 3105 on which the male screw 3119 is formed, thereby any position on the horizontal members in the width direction of the frame 101 is pressed with a pressure corresponding to the rigidity at the position.

In the embodiment, thirty-two pressure rolls 33 are provided for each pressure means 13 to suit with a frame 101 with the maximum size of 27 inches, but the number of pressure roll 33 of each pressure means 13 is variable depending on the frame size to be used.

In the embodiment, the pressure tip is constituted with the pressure roll 33, but the pressure tip may be constituted with a member other than a roll if the friction of the structure and material to the horizontal members 103 is relatively low.

The structure of the frame supporting means 9 and frame positioning means 11 may be different from those described in the embodiment.

In the embodiment, the pressure block 31 of each pressure means 13 is structured so as to be moved by the driving means 15 comprising a single cylinder 3905, but the driving means of each pressure means 13 may be constituted separately.

In the embodiment, the pressure device 5 for pressing a frame 101 which is used when a flat apertured grill 3 is welded is described, but this invention may be used for all pressing operations in fabrication of apertured grills including pressing a pair of horizontal members facing each other and a pair of vertical members facing each other in the direction to bring a member closer to another member.

According to the present invention as described hereinbefore, the pressure device, which presses a pair of members facing each other of a frame for apertured grills comprising four members of top, bottom, right, and left in the direction to bring a member closer to another member, comprises a pair of pressure blocks provided movably in the direction to bring it closer to and farther from the member at position facing to a pair of members respectively outside the frame, driving means for moving synchronously each pressure block in the direction to bring the pressure block closer to and farther from the pair of members, and pressure tips for contacting with the pair of members and supported on the each pressure block.

Therefore, the pressure tips supported on each pressure block contact and press the pair of members in the same motion, thus the pair of members is pressed under the same pressure condition.

According to the present invention, the pressure tip is structured so as to be supported at many positions on the pressure block with a certain space in the direction along the pair of members, thereby each member is pressed at many points along the member with a small pitch, and each member is pressed evenly through the length of the member.

What is claimed is:

1. A pressure device for pressing a frame for apertured grills, which presses a pair of members facing each other of a frame for apertured grills comprising four members of top, bottom, right and left sides in the direction to bring said pair of members together, having:

a pair of pressure blocks provided movably in the direction to bring the pressure blocks closer to and farther from said pair of members located at the position facing to said pair of members outside said frame, driving means for moving synchronously each said pressure block in the direction to bring each said pressure block closer to and farther from said pair of members respectively, and a plurality of pressure tips for contacting with said pair of members and screw adjustably supported toward and away from said pair of members on each said pressure block, respectively.

2. A pressure device for pressing a frame for apertured grills, which presses a pair of members facing each other of a frame for apertured grills comprising four members of top, bottom, right and left sides in the direction to bring said pair of members together, having:

a pair of pressure blocks provided movably in the direction to bring the pressure blocks closer to and farther from said pair of members located at the position facing to said pair of members outside said frame, driving means for moving synchrionously each said pressure block in the direction to bring each said pressure block closer to and farther from said pair of members respectively, and a plurality of pressure tips for contacting with said pair of members and screw adjustably supported toward and away from said pair of members on each said pressure block, respectively, wherein said pressure tips are constituted with rolls rotatable on said pair of members.

3. A pressure device for pressing a frame for apertured grills as claimed in claim 2, further comprising frame positioning means for positioning said frame at the position where said pressure tips face said pair of member.

4. A pressure device for pressing a frame for apertured grills as claimed in claim 1 or claim 2, wherein many of said pressure tips are provided, and each pressure tip is supported respectively on said pressure block at positions with a space along said pair of members.

5. A pressure device for pressing a frame for apertured grills as claimed in claim 4, wherein many pressure tip moving mechanisms for moving individually said each pressure tip in the direction to bring said pressure tip closer to and farther from said pair of members are provided.

6. A device for pressing a frame for constructing an apertured grill for a color selector of a color cathode ray tube, the frame including left and right vertical members and top and bottom horizontal members, comprising:

pair of pressure blocks for opposing said top and bottom horizontal members and movable in a direction toward and away from said top and bottom horizontal members;

driving means for moving said pressure blocks against said top and bottom horizontal members;

said pressure blocks having a plurality of rollers mounted for pressing against said top and bottom horizontal members when said pressure blocks are moved toward said top and bottom horizontal members, wherein said rollers are arranged to roll along said top and bottom horizontal members during pressing of said pressure blocks against said top and bottom horizontal members.

7. The device according to claim 6, wherein said pressure blocks further comprise adjustable mounting means for said rollers, wherein each said roller can be adjustably extended toward and away from said top and bottom horizontal members respectively.

8. The device according to claim 6, further comprising frame positioning means for positioning said frame at a position for contact by said rollers.

9. The device according to claim 8, wherein said frame positioning means comprises:

X-axis positioning means having opposing movable blocks synchronously moved toward and away from each other on guide rails to position the frame in a width direction; and Y-axis positioning means having opposing movable plates moved synchronously toward and away from each other on further guide rails to position the frame in a depth direction.

10. The device according to claim 9, wherein said positioning means comprises vertical positioning means for setting the Z-axis position of the frame with respect to said rollers.

11. The device according to claim 10, wherein said vertical positioning means comprises a swing lever with a press roller mounted at an end thereof, said press roller provided with control means for swinging said press rollers above said left and right members and lifting means for lifting said left and right members up to a vertical limit set by said press rollers.

12. The device according to claim 9, wherein said X-axis and Y-axis positioning means comprise splitting links for synchronously moving said opposing plates and opposing blocks respectively.

* * * * *